United States Patent [19]

Moulding, Jr. et al.

[11] Patent Number: 4,811,844

[45] Date of Patent: Mar. 14, 1989

[54] DUAL LAYERED CARD FOR PERMITTING SELECTIVE ACCESS TO AN OBJECT

[76] Inventors: Thomas S. Moulding, Jr., 214 Via La Soledad, Redondo Beach, Calif. 90277; Donald G. Ellis, Geneva Park, Boulder, Colo. 80302

[21] Appl. No.: 893,867

[22] Filed: Aug. 6, 1986

Related U.S. Application Data

[63] Continuation-in-part of Ser. No. 532,038, Sep. 14, 1983, Pat. No. 4,604,847.

[51] Int. Cl.[4] ..... B65D 73/00

[52] U.S. Cl. ..... 206/459; 206/1.5; 206/232; 206/461; 206/481; 292/307 A

[58] Field of Search ..... 206/232, 459, 461, 477, 206/478, 481, 483, 1.5; 292/307 R, 307 A, 308–326

[56] References Cited

U.S. PATENT DOCUMENTS

| | | | |
|---|---|---|---|
| 2,548,104 | 4/1951 | Frison | 292/307 R |
| 3,147,607 | 9/1964 | Calvino | 292/325 |
| 3,172,692 | 3/1965 | Brooks | 292/325 |
| 3,251,464 | 5/1966 | Hanson | 206/459 |
| 3,251,476 | 5/1966 | Hanson | 206/459 |
| 3,610,411 | 10/1971 | Coleman | 206/459 |
| 4,106,801 | 8/1978 | De Lima Castro Neto | 292/307 R |
| 4,175,782 | 11/1979 | De Lima Castro Neto | 292/307 R |

FOREIGN PATENT DOCUMENTS

| | | | |
|---|---|---|---|
| 2334273 | 7/1977 | France | 206/461 |

*Primary Examiner*—Jimmy G. Foster

[57] ABSTRACT

A card for permitting selective access to an object. The card includes a formed section and a covering in sealing, overlying engagement with the formed section. A beaded, looped wire interconnected with the object is interposed with adhesive between the formed section and the covering, thereby preventing access to the object. Only after the code is read can the interposed portion of the beaded, looped wire be removed from its interposed relation thereby to permit access to the object.

45 Claims, 4 Drawing Sheets

DUAL LAYERED CARD FOR PERMITTING SELECTIVE ACCESS TO AN OBJECT

RELATIONSHIP TO OTHER PATENT APPLICATIONS

This is a continuation-in-part of application Ser. No. 532,038, filed Sept. 14, 1983, U.S. Pat. No. 4,604,847, the subject matter of which is incorporated herein by reference.

BACKGROUND OF THE INVENTION

In scientific, medical, and commercial enterprises, there are numerous relatively simple tasks that demand complete compliance with an established procedure, including accurate recording of certain aspects of performing the tasks. Persons of low intelligence and skill can perform such tasks with only a few errors, however, many tasks must be performed without any mistakes because an error in performing the task will have serious, and sometimes disastrous consequences. For example, errors in maintaining inventory records of shelved products require a great deal of manpower and expense to remedy, and similarly, errors in maintaining accurate records with respect to urine samples, blood specimens, and blood transfusions can be life threatening. Consequently, overskilled persons, who demand higher compensation, are hired to perform these tasks in order to minimize, if not eliminate, any errors.

The present invention relates to a dual layered, code bearing card for permitting selective access to an object and which is especially suitable for inventory regulation. The card forces certain procedures to be followed and automatically records information concerning the procedures before access to an object is permitted. Therefore, the card allows relatively simple tasks to be performed error-free with relatively unintelligent, unskilled, and inexpensive labor.

SUMMARY OF THE INVENTION

The present invention relates to a dual layered, code bearing card for permitting selective access to an object. The card includes a formed section and a covering in sealing, overlying engagement with the formed section. A beaded, looped wire interconnected with the object is interposed with adhesive between the formed section and the covering, thereby preventing access to the object. Only after the code is read can the interposed portion of the beaded, looped wire be removed from its interposed relation thereby to permit access to the object.

BRIEF DESCRIPTION OF THE DRAWINGS

The invention will be described with reference to the accompanying drawings wherein.

DESCRIPTION OF A PREFERRED EMBODIMENT

Figure 1:
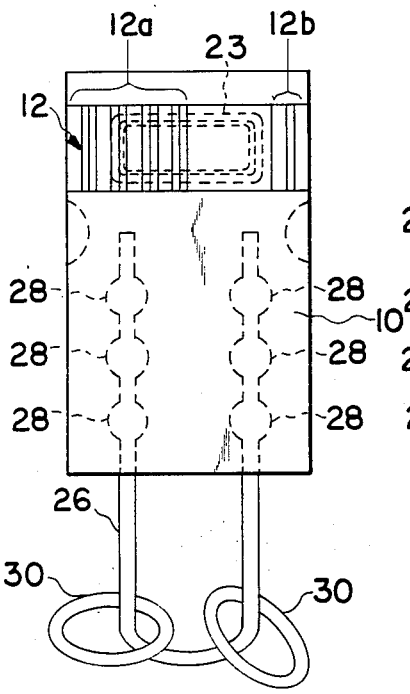
FIG. 1 is a front view of a dual layered, code bearing card in accordance with one embodiment of the present invention.
Figure 2:
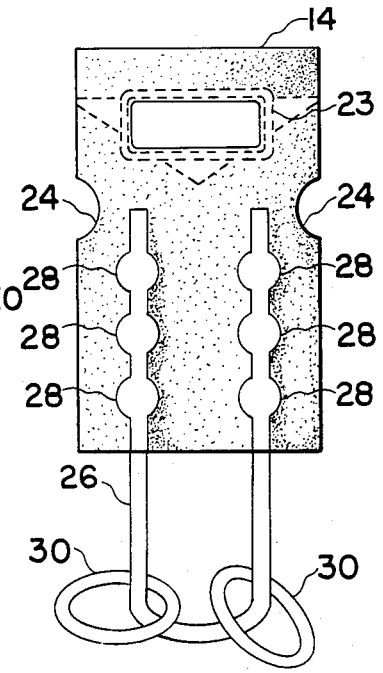
FIG. 2 is a front view of the card shown in FIG. 1 with the covering removed to expose the areas of adhesion.
Figure 3:
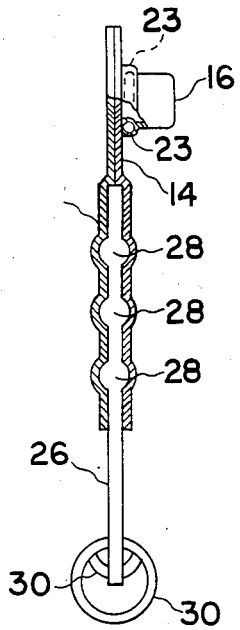
FIG. 3 is a side view of the card shown in FIG. 1 in partial cross-section.

Referring now to the drawings wherein like reference numerals and symbols refer to the same item, there is shown in FIGS. 1 through 3, a dual layered, code bearing card according to one embodiment of the present invention. The card includes a sheet-like covering 10 bearing a code, such as a machine readable code 12. The code 12 may comprise a main code **12*a* and an end code 12*b*. The code 12 may comprise a series of spaced bars (or bar code), as depicted in the drawings, or may comprise some other code such as a magnetic code, or may comprise a combination of a bar code and a magnetic code. The card also includes a backing or formed section 14 including a reservoir forming depression 16 disposed near an upper end thereof. The covering 10 and the formed section 14** preferably are each fashioned of tough, semi-rigid plastic and may be fashioned in whole or in part of metal.

The cover 10 is preferably maintained in a sealing engagement against the formed portion 14 by means of an adhesive. The adhesive is preferably applied between the covering 10 and the formed section 14 as shown in FIG. 2. The code bearing portion of the covering 10 is generally disposed above the reservoir forming depression 16 and generally is not in contact with the area where adhesive is present.

The card preferably includes a ring 23 preferably fashioned of wire, fiberglass, or other strong material disposed near the covering in a correspondingly shaped depression around, or alternatively embedded in, the wall of the reservoir forming depression 16. Alternatively, a U-shaped member with the open end of the U-shaped member facing toward the bottom of the page in FIG. 1 can be substituted for the ring. The ring or U-shaped member substantially prevents the card from being severed in the region of the reservoir forming depression 16 by conventional cutting means such as scissors.

The foregoing description of a preferred embodiment has been described in more detail in the above-referenced copending patent application, the subject matter of which is incorporated herein by reference. Such copending patent application also discloses in detail a special machine for reading the code, rendering the code unreadable, and cutting the covering 10 in the region of the code 12 to permit the initiation of the separation of the covering 10 from the formed section 14 by grasping the covering 10 in a region where there is no adhesive and then peeling back the covering 10 with respect to the formed section 14.

The card shown in FIGS. 1 through 3 includes a generally U-shaped thread or cord 26 fashioned of wire, fiberglass, plastic or other strong material. The upper one-half portion of each arm of the U-shaped cord is interposed between the covering 10 and the formed section 14. The sealing engagement of the covering 10 over the formed section 14 by means of the adhesive substantially prevents the U-shaped cord 26 from being pulled out from between the covering 10 and the formed section 14. To further inhibit the U-shaped cord 26 from being removed from its interposed position, a series of spaced bulbous beads 28, preferably integrally formed with the U-shaped cord 26, are disposed along the upper one-half portion of each arm of the U-shaped cord 26.

Figure 10:
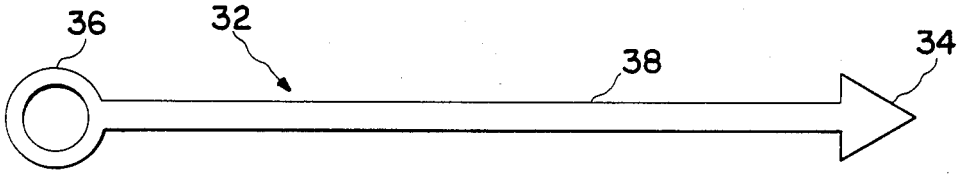
FIG. 10 is a top view of an arrow-shaped member that can be formed into a ring.

The card shown in FIGS. 1 through 3 is ideally suited for being applied at a factory where the object of interest is being packaged. For example, sulfuric acid may be placed in the bottle with a cap or closure at a factory. The closure and the bottle would each be provided with a corresponding ring or eyelet or with a part of a hasp through which the U-shaped cord 26 passes, and thereafter the upper one-half of the U-shaped cord 26 would be "sandwiched" between the covering 10 and the formed section 14 along with adhesive. The card would thus function like a padlock, and the closure could not be easily removed from the bottle to provide access to the sulfuric acid until the code was read and the covering 10 was cut with the cutting machine described in the copending patent application. Alternatively, a pair of rings 30 may be retained by the U-shaped cord 26 and the rings 30 may be secured to the corresponding closure eyelet or bottle eyelet to permit selective access to the sulfuric acid. Each ring 30 may be formed by a flexible, arrow-shaped member 32, as shown in FIG. 10. The arrow-shaped member 32 includes a conical projection 34 at one end thereof and includes an O-ring 36 at the other end thereof. The conical projection 34 and the O-ring 36 are interconnected by a shaft 38 and are preferably integrally formed therewith. The diameter of the base of the conical projection 34 is slightly larger than the internal diameter of the O-ring 36 so that the conical projection 34 may be forced through the O-ring 36 due to the compressible, deformable character of the material comprising the conical projection 34 and/or the O-ring 36. However, the conical projection 34 cannot be retracted back through the O-ring 36 due to the shape of the base of the conical projection 34. When the card shown in FIGS. 1 through 3 is used with rings 30 created by the arrow-shaped member 32, the card can advantageously be applied outside the factory where the object is being packaged.

The materials used to form the card can comprise hardened paper products, fiberglass, hard plastic, or metal, depending upon the degree of security desired in selectively permitting access to the object.

One can readily appreciate that the card disclosed in FIGS. 1 through 3 can be used advantageously to permit selective access to the variety of the objects. For example, where the object is within a bottle having a screw-on cap, the cap and the bottle can each be provided with an eyelet which is secured to either the U-shaped cord 26 or the rings 30 retained on the U-shaped cord 26 so that the screw-on cap cannot be removed from the bottle without reading and recording the code 12 and severing the covering in the region of the code with the special cutting machine described in the copending patent application. Similarly, one of the rings 30 may be attached to a bar, a ring, or the like secured to a shelf and the other ring 30 can be attached to a can to prevent the can from being removed from the shelf without reading and recording the code 12 and severing the covering 10 in the region code 12 with the special cutting machine described in the copending patent application. Likewise, the rings 30 can be attached to a corresponding end of a band wrapped around a box having a lid, which box contains the object.

Figure 4:
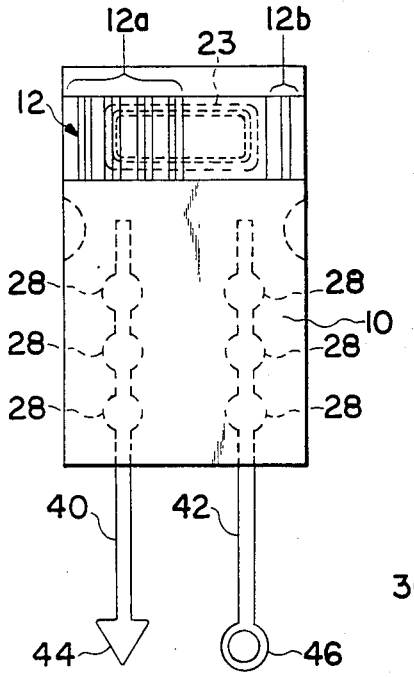
FIG. 4 is a front view of a dual layered, code bearing card in accordance with a second embodiment of the present invention.
Figure 5:
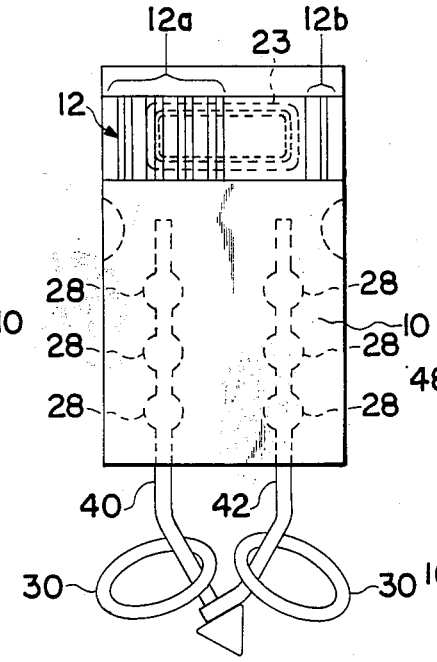
FIG. 5 is a front view of the card shown in FIG. 4 with the pair of rings and with a conical projection extending through a retaining ring.

FIGS. 4 and 5 disclose yet another embodiment of a dual layered, code bearing card according to the present invention. The card includes a covering 10 and a formed section 14 in all respects similar to the card shown in FIGS. 1 through 3. Instead of a U-shaped cord 26, the card includes a pair of linear, cooperating cords 40, 42. One-half of each linear cord 40, 42 is interposed between the covering 10 and the formed portion 16 and possesses a series of spaced, bulbous beads 28. The noninterposed end of one of the linear cords 40 is provided with a conical projection 44 similar in all respects to the conical projection 34 of the arrow-shaped member shown in FIG. 10. The noninterposed end of the other linear cord 42 is provided with an O-ring 46 similar in all respects to the O-ring 36 of the arrow-shaped member shown in FIG. 10. When the conical projection 44 is inserted through the O-ring 46, the joinder of the cooperating, linear cords 42 functions the same as the U-shaped 26 of the card shown in FIGS. 1 through 3. Rings 30 may also be retained by the joined, cooperating, linear cords 40, 42. The linear cords 40, 42 may be fashioned of any of the same materials as a U-shaped member 26.

Figure 6:
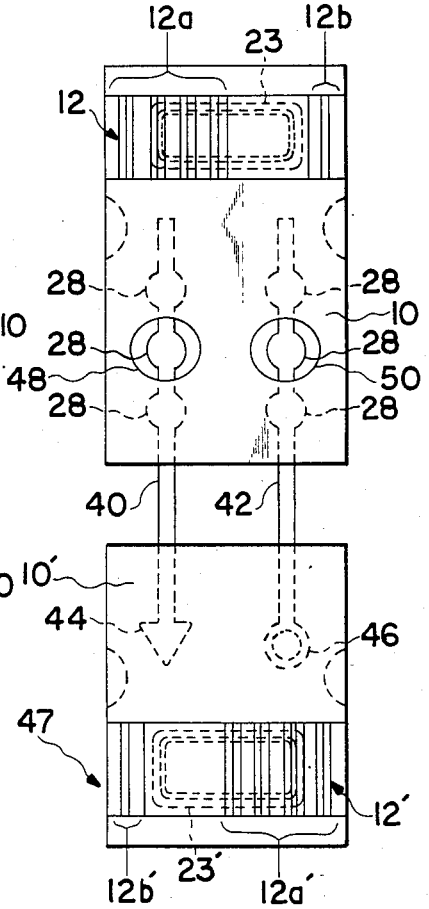
FIG. 6 is a front view of a dual layered, code bearing card in accordance with yet another embodiment of the present invention.

A dual layered, code bearing card according to yet another embodiment of the present invention is disclosed in FIG. 6. This card is the same in all respects as the card shown in FIG. 4, except that a hole 48 is provided in the covering 10 over a bulbous bead 28 of the linear member 40 and a hole 50 is provided in the covering 10 over the corresponding bulbous bead 28 in the linear member 42, and except that the conical projection 44 and the O-ring 46 are interposed with adhesive between a second covering 10' and a second formed section 14' in all respects similar to the covering 10 and the formed section 14 of the dual layered, code bearing card shown in FIGS. 1 through 3 and the dual layered, code bearing card shown in FIGS. 4 through 5. The second covering 10', the second formed section 14', and the adhesive therebetween are hereinafter called a tag 47. In using the card shown in FIG. 6, as will be described in greater detail later herein, the conical projection 44 and the O-ring 46 are removed from the tag and then are joined in the manner previously described herein.

Figure 7:
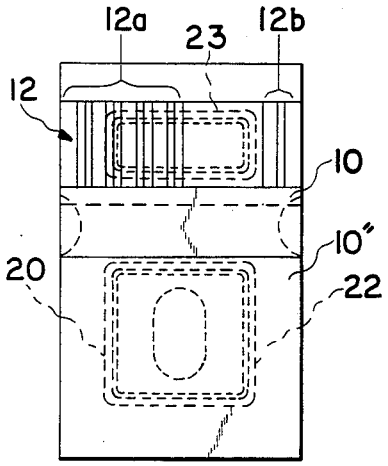
FIG. 7 is the front view of a dual layered, code bearing card in accordance with still another embodiment of the present invention.
Figure 8:
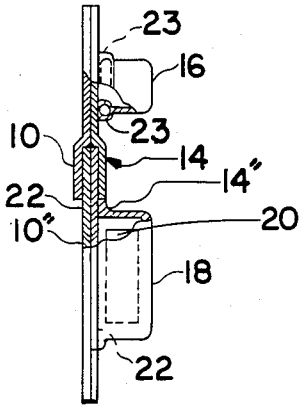
FIG. 8 is a side view of the card shown in FIG. 7 in partial cross-section.

FIGS. 7 and 8 show yet another embodiment of a dual layered, code bearing card according to the present invention. The card includes a covering 10 and a formed section 14 similar in all respects to the covering 10 and the formed section 14 of the dual layered, code bearing cards in FIGS. 1 through 3, FIGS. 4 and 5, and FIG. 6. The card also includes a second formed section 14" having a reservoir forming depression 18 and a covering 10" overlying the formed section 14" in sealing engagement by means of an adhesive. A pill 20 or other object is located within the reservoir forming depression 18. A portion of the covering 10" and a corresponding portion of the formed section 14" are not adhered together. Such nonadhered portion of the covering 10" and the formed section 14" is interposed between the covering 10 and the formed section 14 of the card. The covering 10 is adhered by adhesive to the covering 10", and the formed section 14 is adhered by adhesive or the like to the formed section 14". Again, by reading and recording the code 12 and severing the code bearing region of the covering 10 with the special machine disclosed in the copending patent application, the covering 10 can be peeled back from the formed section 14, which in turn exposes the nonadhered region of the covering 10" and the formed section 14", which permits the covering 10" to be peeled back from the formed section 14" to expose the pill 20 or the like.

Figure 9:
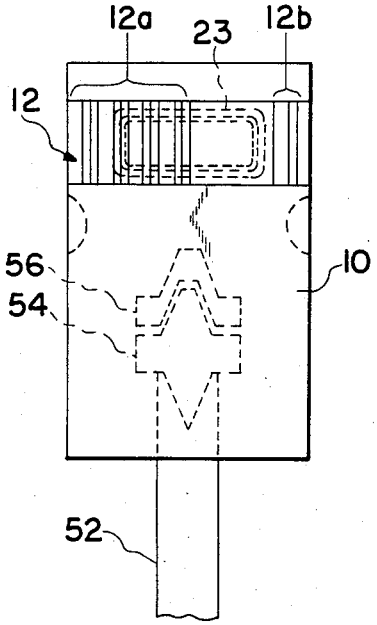
FIG. 9 is a front view of a dual layered, code bearing card in accordance with another embodiment of the present invention.

A dual layered, code bearing card in accordance with yet another embodiment of the present invention is shown in FIG. 9. The card includes a covering 10 overlying and sealingly engaging a formed section 14 in all respects similar to the covering 10 and the formed section 14 in the card shown in FIGS. 1 through 3, FIG. 4 and 5, FIG. 6, and FIGS. 7 and 8. A tube 52 having a permanently attached end fitting 54 and a cap 56 mounted over the end fitting 54 are interposed between the covering 10 and the formed section 14. Again, by reading and recording the code 12 and severing the code bearing region of the covering 10 with the special cutting machine disclosed in the copending patent application, the covering 10 may be peeled back from the formed section 14 to expose the cap 56 and permit the same to be disengaged from the end fitting 54.

Figure 11:
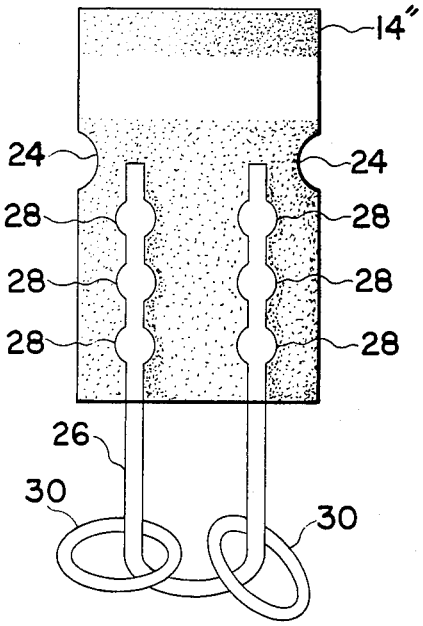
FIG. 11 is a front view of a dual layered, code bearing card in accordance with another embodiment of the present invention with the covering removed to expose the areas of adhesion.
Figure 12:
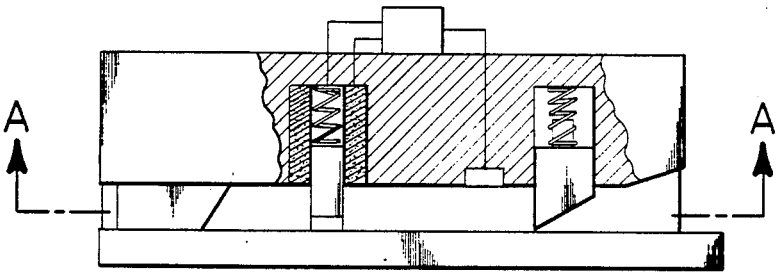
FIG. 12 is a schematic illustration of a cross-sectional side view of a cutting machine used in accordance with one embodiment of the present invention.
Figure 13:
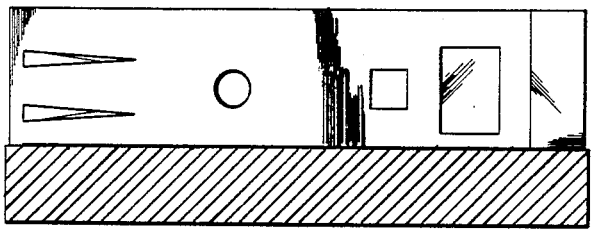
FIG. 13 is a schematic illustration of the cutting machine as shown in FIG. 12 as taken along the line A—A.
Figure 14:
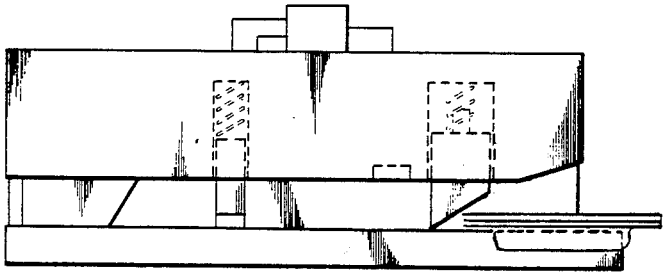
FIG. 14 is a schematic illustration of the cutting machine showing the position of a medicine package or a dual layered card as it first enters the cutting machine.
Figure 15:
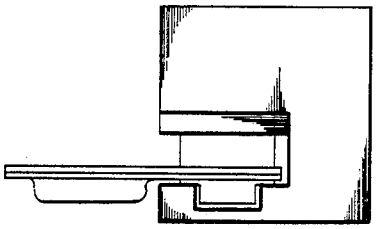
FIG. 15 is a schematic illustration of an end view of the cutting machine and medicine package shown in FIG. 14.
Figure 16:
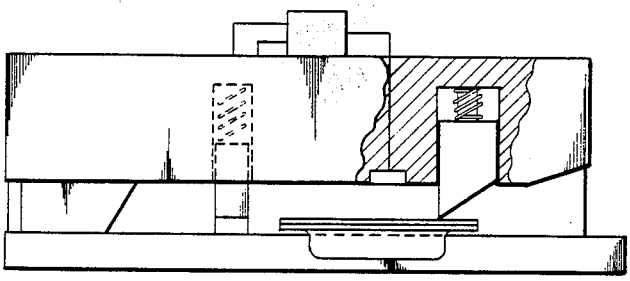
FIGS. 16 and 17 are schematic illustrations of the cutting machine according to FIG. 14 showing the progress of the medicine package as it advances through the cutting machine.
Figure 17:
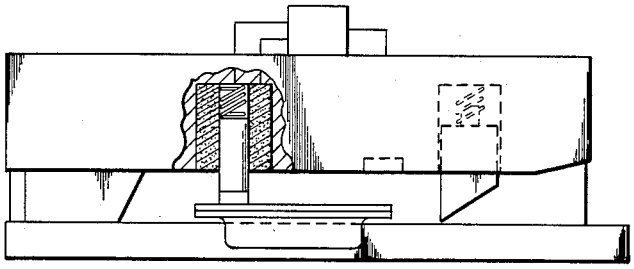

A portion of a dual layered, code bearing card in accordance with yet another embodiment of the present invention is shown in FIG. 11. The card includes a covering which is removed and not shown in FIG. 11 and which is in all respects similar to the coverings previously described herein and includes a flat backing or formed section 14''' without any reservoir forming depression or any ring surrounding a reservoir forming depression. The shaded areas in FIG. 11 indicate the regions where an adhesive adheres the covering to the flat formed section 14''' and reveals a nonadhered strip extending laterally across the card beneath the code bearing region on the covering. Such a dual layered, code bearing card can be passed through the machine described in the above-referenced copending patent application with the depth of the knives in the machine being adjusted and selected so that the covering is cut in the area of the code without the knives cutting through the flat section 14'''. Because the code bearing portion of the covering is not adhered to the flat formed section 14''', the covering may be peeled from the flat formed section 14''' to liberate the U-shaped cord 26 or the linear, cooperating cords 40,42. Furthermore, the flat formed section 14''' may be constructed entirely, or in the region of no adhesion, of a tough material such as metal to prevent the card from being severed in the region of the code with conventional cutting means such as scissors. The card shown in FIG. 11, without a depression 16 or ring 23, can be advantageously adapted for use with the packages depicted in FIGS. 1 through 10 of the copending patent application and in FIGS. 7 and 8 of this continuation-in-part patent application.

Several uses of the card according to the present invention will now be described.

The dual layered, code bearing card according to the present invention may be used for inventory control in warehouses. Each item (such as a can, bottle, box, etc.) in the warehouse would be provided with a machine readable code identifying the contents of the item. Each of the items would also be provided with a ring, eyelet or hasp to which a card could be attached. All shelves, drawers, or floor areas in the warehouse would be provided with a machine readable code designating the particular shelf, drawer, or area of floor space, and furthermore, each shelf, drawer, and area of floor space would be provided with a permanently stationary bar, series of rings, or the like to which the card could be attached. A person in charge of inventory control would also be provided with a machine readable code uniquely describing his name or other identification.

In operation, the person in charge of inventory control would utilize a bar code reading or magnetic code reading pen or wand such as the bar code reading pens commonly used in checking out books from libraries interconnected with the computer controller of the special cutting machine described in the copending patent application. The person would sometimes utilize the machine only for reading and recording the code and not for cutting any code bearing portion of the covering. This utilization of the machine will be referred to hereinafter as the noncutting mode and can be accomplished by selectively retracting the pair of knives in the machine away from the card. The person would use either the wand or the machine (in a noncutting mode) to read and record his personal code, then would take items to the shelves, etc. and attach a card to the corresponding item and to a bar, one of the series of rings, or the like, then would use the wand to read and record the code on the shelf, etc., the code on the item, and the code on the card. Alternatively, the code on the card could be read by the machine in a noncutting mode. Thus, the computer controller of the machine would have recorded and stored in its memory the identity of the person stocking the item, the identity of the item, the location of the shelf where the item was stocked, and an identification of the dual layered, code bearing card connecting the item to the bar, ring, or the like. Also, the computer controller could record and store the time and date when any of these recordings occurred. The information stored and recorded in the computer controller could be transferred to a central computer in the warehouse.

When removing stocked items from inventory, the central computer could provide a list of where the desired, stocked items are located in the warehouse and could provide information respecting how old or stale a particular item was, so that relatively old items could be removed from inventory first. A person in charge of inventory control proceeds to the warehouse location where the central computer indicates that the desired, stocked items are located, then uses either the wand or the machine (in a noncutting mode) to read and record his personal code, and then uses the machine to read and record the code 12 and to sever the covering 10 in the region of the code to permit the covering 10 to be peeled from the formed section 14 and thereby permit the item to be released from the bar, ring, etc. This latter utilization of the machine will be referred to hereinafter as the cutting mode of the machine. The machine would be incapable of operating in a cutting mode unless the person had previously used either the wand or the machine (in a noncutting mode) to read and record his personal code within a selected time. Moreover, since the central warehouse computer would designate exactly what desired, stocked items were to be removed from inventory, such information could be transferred from central warehouse computer to the computer controller of the machine, which in turn, would prohibit the machine by means of the gate therein from cutting any card that was associated with an item not designated by the central warehouse computer for desired removal from inventory. Similarly, the time and the date when any reading or recording operation is performed could also be recorded. Thus, the identity of an item removed from inventory, the time and date when the item was removed from inventory, and the identity of the person who removed the item from inventory is maintained by the computer controller, and this information can be transferred to the central warehouse computer.

An inventory check is extremely easy by simply reading and recording, but not cutting, each of the cards. Such an inventory check would quickly establish what items are stocked in inventory and would quickly reveal a great deal of information about any items which should be stocked in inventory, but which are missing from inventory because of such acts as theft. Moreover, the use of the card would provide an exact indication of how many items a person stocked or removed from inventory, thereby providing an indication of that person's productivity.

The card of the present invention can also be used to maintain a lubrication record for machinery such as a fleet of cars or trucks. Each lubrication point on each piece of machinery would be closed with a hinged cap. The machinery near the cap would be provided with a ring, eyelet or hasp, and the hinged cap would also be provided with a ring, eyelet, hasp, or the like so that a card could be attached to the ring, etc. on the machinery and the ring, etc. on the hinged cap. A machine readable code would be associated with each lubrication point and would identify the lubrication point and the machinery. A dual layered, code bearing card would first be attached to the rings, etc. at each lubrication point, and the code on the card and the code associated with the lubrication point would be read either by the wand or the machine (in a noncutting mode) to provide the computer controller with an association between the card and the lubrication point. A person assigned to lubricate any lubrication point would first read and record his personal code with the wand or the machine (in a noncutting mode), would then use the machine (in a cutting mode) to read and record the card code and to sever the covering 10 in the region of the code so that the covering 10 can be peeled from the formed section 14 to permit the hinged cap to be opened and provide access to the lubrication point. The wand would then be used to read and record a bar code or other machine readable code associated with a bottle or can of lubricant which identifies the lubricant used to lubricate the lubrication point. After lubricating the lubrication point, the person would attach a new dual layered, code bearing card to the lubrication point ring, etc. and to the hinged cap ring, etc. and then use either the wand or the machine (in a noncutting mode) to read and record the new card code. The machine could also record the time and date when any of these activities were performed. Again, the machine's computer controller could be programed to prevent the machine from cutting any code bearing portion of a covering 10 unless the person's code had been read within a predetermined time period or unless other codes had been read within a predetermined time period. The information read and recorded by the machine's computer controller could be transferred to a central computer which would provide a record of what lubrication point was lubricated, what lubricant was used to lubricate the lubrication point, when the lubrication point was lubricated, and who lubricated the lubrication point. If the central computer is programed with information concerning the time intervals when each lubrication point should be lubricated, then the central computer can also provide instructions as to when each lubrication point needs relubricating.

In the preceding examples, a record may be made of when a machine reads the code of a card presumably being attached to an item, however, there is no assurance that the card has been or is actually being attached to an item since the card code can be read either before or after attachment. In order to provide assurance as to a time when a card is being attached to an item, the card shown in FIG. 6 can be used. The machine reads the code 12' of the tag 47, cuts the covering 10' in the region of the code 12', thereby permitting removal of the conical projection 44 and the O-ring, which in turn permits the card to be attached to the item by inserting the conical protrusion 44 through the O-ring 46 as shown in FIG. 5. The use of tag 47 makes it possible to establish that the dual layered, code bearing card could not have been attached prior to the time when the tag 47 was removed from the conical projection 44 and the O-ring 46. Since in the card shown in FIG. 6, the corresponding linear cords 40, 42 are fashioned of electrically conductive metal, the insertion of the conical protrusion 44 through the O-ring 46 creates an electrical connection between the linear cord 40 and the linear cord 42. The machine described in the copending patent application may be modified so that an electrical charge may be applied to the bulbous bead 28 exposed by the hole 48 in the covering 10 and whereby the charge may be removed from the bulbous bead 28 exposed through the hole 50 in the covering 10 when the conical projection 44 is inserted through the O-ring 46 to create an electrical connection. When the conical projection 44 does not extend through the O-ring 46 to make the electrical connection, then an electrical charge applied to the bulbous bead 28 exposed at the hole 48 of the covering 10 cannot be withdrawn from the bulbous bead 28 exposed by the hole 50 in the covering 10, and this circumstance can be detected by appropriate means added to the machine. Thus, unless the machine detects the electrical connection, which indicates that the conical projection 44 has been inserted through the O-ring 46, the machine can be prohibited from recording the information indicated by the code 12 of the card. When the machine reads the code 12 and also determines that the electrical connection is established, the time is recorded. This time and the time recorded when the tag 47 was removed establishes a time frame within which the card shown in FIG. 6 was attached to the item. Consequently, the card as shown in FIG. 6 may be used to provide a more reliable indication as to when a card has been attached to an item.

The card of the present invention may be used effectively in the medical field such as in the process of obtaining and transfusing blood. A mismatched blood transfusion is an error in a relatively routine medical procedure that has potentially tragic consequences. Such a mismatch can occur in any one of several steps of the transfusion process: properly identifying blood drawn from a donor, cross-matching the blood with an aliquot of the blood required by the patient, and transfusing the blood into the correct patient. To make sure the blood from a donor is properly identified, all empty blood specimen containers would have a cap locked to the container by a dual layered, code bearing card. The container would have a separate machine readable code identifying the container; the donor would have a machine readable code on his armband to identify the donor; and the nurse or other person drawing the blood would have a machine readable code identifying the nurse. The nurse or other person drawing the blood would use either the wand or the machine described in the copending patent application (in a noncutting mode) to read the nurse's code, and to read the donor's code. Then the nurse would draw the donor's blood, use the wand to read the label on the container, use the machine (in a cutting mode) to read the card code and sever the card covering in the region of the code, open the cap on the container, place the blood in the container, close the cap, seal the cap with a new card such as the card shown in FIG. 6, and read the code on the new card with the machine (in a noncutting mode) upon establishing that the electrical connection between the joined wires 40 and 42 exists.

The computer controller of the machine could be programed to require the reading or recording procedures to be performed in a prescribed sequence within a specified time period so that, for example, the machine would not permit severing of the covering of the card attached to the empty container unless the donor's code was previously read by the machine within a certain limited time period, or the machine would be permitted to cut the covering 12' on the tag 47 of the card to be attached to the container holding the blood only within a certain time period after the covering of the card attached to the empty container had been read. Furthermore, the time when the electrical connection between the joined wires 40 and 42 was tested and either found to be established or not established could be recorded. These time requirements would help insure that all of the procedures were performed within a certain maximum time interval, thereby increasing the degree of confidence that the blood in the container was drawn from the donor. Moreover, the computer controller of the machine could record the time and date when each of the codes was read or recorded. The information in the computer controller of the machine can of course be transferred to a central computer in the hospital, nursing home, etc. Thus, a computer will always maintain a record of the code on the container and the code on the card attached to the container. If at any time the code on the card actually attached to the container does not conform with the code that the computer indicates should be on the container, then the article within the container will be immediately suspect.

The nurse drawing the blood might be able to circumvent the foregoing procedures by drawing the blood a long period of time before reading the donor's armband, opening the container, placing the blood in the container, and re-locking the container. This procedure would increase the possibility of a misidentified blood specimen. To eliminate this possibility, and to further increase the presumption that a blood specimen within a container is from a specific donor, the needle and syringe used to draw the donor's blood could be placed in the package shown in FIG. 8 of the copending patent application. The computer controller of the machine would be programed to permit such package containing a needle and syringe to be opened only if the donor's code was previously read within a selected time period. To further eliminate errors in the foregoing blood transfusion process, the syringe can be provided with a machine readable code, and means can be provided for determining the intensity of light transmitted through a syringe or reflected from the syringe (which would indicate the absence or presence of blood within the syringe). The required time between a reading indicating an empty syringe and a reading indicating a blood filled syringe could be relatively short, which further increases the presumption that the syringe was filled with the donor's blood.

The procedure for the transfusion of the donored blood into a patient could be as follows: read and record the code on the container of blood; read and record the coded package containing a needle and syringe or tubing to start infusion and open such package; read and record the patient's code; read and record the nurse's code; read and record the code on a dual layered, code bearing card such as the card depicted in FIG. 9 and cut the covering of such card so that the cap and tubing assembly leading to the blood is free; and attach the tubing to the infusion which has already begun. Again, time limits could be set so that any steps of the procedure would be required within a selected time interval. The computer could be programed to monitor compatible blood types so that a donor's blood would not be mismatched with an incompatible patient by signaling the nurse after the patient's code is read, such as by a beeping noise, and preventing the covering on the card attached to the cap and tubing from being severed if the patient's code indicates that the patient's blood is incompatible with the donor's blood contained in the container.

Although particular embodiments of the present invention have been described and illustrated herein, it should be recognized that modification and variations may readily occur to those skilled in the art and that such modifications and variations may be made without departing from the spirit or the scope of my invention. Consequently, my invention as claimed below may be practiced otherwise than is specifically described above.

I claim:

1. A device for controlling access to an object comprising two sheets of material disposed in an overlapping relation, said sheets being separably bonded together such that said sheets are capable of being separated substantially only with a tool whereby access to the object is permitted, at least one of said sheets bearing at least one machine readable code.

2. A device for controlling access to an object according to claim 1 wherein said sheets are bonded together in a part of the area of overlap and are not bonded together in another part of the area of overlap and wherein said sheets are adapted to be severed by the tool in the non-bonded area of overlap.

3. A device for controlling access to an object according to claim 2 wherein said sheets are spaced from each other in a portion of the non-bonded area of overlap and wherein said sheets are adapted to be severed by the tool in the non-bonded area of spaced overlap.

4. A device for controlling access to an object according to claim 3 wherein one of said sheets is provided with a cupped shape depression and wherein said cupped shape depression forms the space.

5. A device for controlling access to an object according to claim 3 further comprising a substantially planar structure surrounding at least a portion of the non-bonded area of spaced overlap.

6. A device for controlling access to an object according to claim 5 wherein said structure comprises a ring.

7. A device for controlling access to an object according to claim 2 wherein said code is positioned in the non-bonded area of overlap.

8. A device for controlling access to an object according to claim 2 wherein said sheets can be separated to permit access to the object when the continuity of one of said sheets has been interrupted in the non-bonded area of overlap.

9. A device for controlling access to an object according to claim 2 wherein at least one of said sheets is fashioned in the non-bonded area of overlap of metal.

10. A device for controlling access to an object according to claim 2 wherein the boundary between the bonded area of overlap and the non-bonded area of overlap is angular.

11. A device for controlling access to an object according to claim 1 wherein the tool is a cutting tool.

12. A device for controlling access to an object according to claim 11 wherein the tool is a knife.

13. A device for controlling access to an object according to claim 1 bearing at least two machine readable codes, one of said codes indicating the identity of the object and the other of said codes providing a reference of the position of the device relative to a machine including the tool.

14. A device for controlling access to an object according to claim 1 wherein the object comprises at least one cord.

15. A device for controlling access to an object according to claim 14 wherein said cord is provided with at least one protuberance interposed between said sheets.

16. A device for controlling access to an object according to claim 14 wherein the object comprises two cooperating cords, one of said cord provided with a ring, and the other of said cords provided with a tapered projection adapted for forceful insertion through the ring.

17. A device for controlling access to an object according to claim 1 wherein one of said sheets is provided with a cupped shape depression defining a portion of a cavity for containing the object and the other of said sheets covering the cupped shape depression and also defining a portion of the cavity.

18. A device for controlling access to an object according to claim 17 wherein said machine readable code is located on a portion of one of said sheets remote from said depression.

19. A dual layered card for permitting selective access to an object comprising:

a backing section;

a covering separably bonded to said backing section such that said covering and said backing section are capable of being separated substantially only with a tool;

a machine readable code positioned on the card; and means for permitting access to the object, at least a portion of said access permitting means being interposed between said backing section and said covering, and said access permitting means being substantially incapable of permitting access to the object when the portion thereof is so interposed and being capable of permitting access to the object when the portion thereof is removed from such interposition relation.

20. A dual layered card for permitting selective access to an object according to claim 19 wherein said backing section includes a depression inwardly from the edges thereof, wherein the code is positioned in the region of the depression and the region of said covering disposed over the depression.

21. A dual layered card for permitting selective access to an object according to claim 19 wherein said covering and said backing section are separably bonded with an adhesive.

22. A dual layered card for permitting selective access to an object according to claim 19 wherein the interposed portion of said access permitting means includes at least one cord, said cord including at least one bulbous section.

23. A dual layered card for permitting selective access to an object according to claim 22 wherein said cord includes a series of spaced bulbous sections and wherein said bulbous sections are formed integral with said cord.

24. A dual layered card for permitting selective access to an object according to claim 23 wherein said cord is fashioned of metal.

25. A dual layered card for permitting selective access to an object according to claim 19 wherein said access permitting means includes a cord, said cord having a portion thereof interposed between said formed section and said covering and having a portion thereof in a noninterposed relation and formed in a loop.

26. A dual layered card for permitting selective access to an object according to claim 25 wherein the interposed portion of said cord includes a series of spaced bulbous sections and wherein said bulbous sections are formed integral with said cord.

27. A dual layered card for permitting selective access to an object according to claim 19, wherein said access permitting means includes a pair of cooperating cords, each cord having a portion thereof interposed between said formed section and said covering and having a portion thereof in a noninterposed relation, wherein said access permitting means further includes means for joining the noninterposed cord portions.

28. A dual layered card for permitting selective access to an object according to claim 27 wherein said joining means includes a retaining ring and a substantially conically shaped projection, the materials and shapes of said retaining ring and said projection being selected such that said projection may be forcefully inserted through said retaining ring but is substantially prohibited from said retracted back through said retaining ring, and wherein said retaining ring and said projection are connected to a corresponding one of the noninterposed cord portions.

29. A dual layered card for permitting selective access to an object according to claim 28 wherein said retaining ring and said projection are formed integral with a corresponding one of the noninterposed cord sections.

30. A dual layered card for permitting selective access to an object according to claim 28 further comprising a dual layered tag, said tag including a tag backing section, tag covering for said tag backing section sealing engaging said tag backing section, said retaining ring and said projection being interposed between said tag backing section and said tag covering, and a machine readable tag code positioned on said tag.

31. A dual layered card for permitting selective access to an object according claim 27 wherein said cord is fashioned of an electrically conductive material.

32. A dual layered card for permitting selective access to an object according to claim 31 further comprising means for permitting an electrical charge to be applied to one of said cords and to be removed from the other of said cords.

33. A dual layered card for permitting selective access to an object according to claim 19 wherein said access permitting means comprising two overlapping sheets of materials capable of being peeled apart.

34. A dual layered card for permitting selective access to an object according to claim 33 wherein said backing section is secured to one of said sheets and said covering is secured to the other of said sheets.

35. A dual layered card for permitting selective access to an object according to claim 19 wherein said access permitting means includes an end of a tube and a cap adapted for sealing the tube end.

36. A dual layered card for permitting selective access to an object according to claim 19 wherein said machine readably code is located on a portion of said card remote from said access permitting means.

37. A dual layered card for permitting selective access to an object according to claim 19 further comprising a second machine readable code, one of said codes indicating the identity of the object and the other of said codes providing a reference of the position of the package relative to a machine including the tool.

38. A system for selectively providing access to an object including:

a dual layered card including (a) a backing section;

(b) a covering separably bonded to said backing section such that said covering and said backing section are capable of being separated substantially only with a tool; and (c) a machine readable code positioned on the card;

means for permitting access to the object, at least a portion of said access permitting means being interposed between said backing section and said covering and said access permitting means being substantially incapable of permitting access to the object when the portion thereof is so interposed and being capable of permitting access to the object when the portion thereof is removed from such interposition relation; and a machine including (a) means for guiding the code bearing portion of the card to a selected position;

(b) means for reading the code when the code bearing card portion is in the selected position; and (c) a tool for separating said covering and said backing section.

39. A system for selectively providing access to an object according to claim 38 wherein the object is disposed in a container having a closure and wherein said access permitting means is connected to the closure and to the container.

40. A system for selectively providing access to an object according to claim 38 wherein said machine readable code is located on a portion of said card remote from said access permitting means.

41. A system for selectively providing access to an object according to claim 38 further comprising a second machine readable code, one of said codes indicating the identity of the object and the other of said codes providing a reference of the position of the package relative to said machine.

42. A package comprising a formed section and a covering for the formed section, the formed section including a first cupped shaped depression disposed toward an associated end thereof and inwardly from the edges thereof and including a second cupped shape depression containing an object and disposed inwardly from the edges thereof, said covering sealingly engaging the formed section except in the area of the depressions and in a portion of the area surrounding the first cupped shape depression, the package further comprising at least one machine readable code positioned in the region of the first cupped shaped depression and the region of said covering disposed over the first cupped shape depression.

43. A package according to claim 42 further comprising a first substantially planar structure substantially surrounding at least a portion of the first cupped shape depression and further comprising a second substantially planar surface substantially surrounding at least a portion of the second cupped shape depression.

44. A package according to claim 43 wherein each said structure comprises a ring.

45. A package according to claim 42 bearing at least two machine readable codes, one of said codes indicating the identity of the object and the other of said codes providing a reference of the position of the package relative to a machine for reading the machine readable codes.

* * * * *